United States Patent [19]

Becker et al.

[11] Patent Number: 4,527,505

[45] Date of Patent: Jul. 9, 1985

[54] DEVICE FOR CONVEYING A FLEXIBLE TUBING AND A FLUID MEDIUM CONTAINED THEREIN

[75] Inventors: Reinhold Becker, Wiesbaden; Helmut Sattler, Wiesbaden-Schierstein, both of Fed. Rep. of Germany

[73] Assignee: Hoechst Aktiengesellschaft, Frankfurt am Main, Fed. Rep. of Germany

[21] Appl. No.: 497,422

[22] Filed: May 24, 1983

[30] Foreign Application Priority Data

May 25, 1982 [DE] Fed. Rep. of Germany ..... 3219525

[51] Int. Cl.[3] ..... B05C 7/04

[52] U.S. Cl. ..... 118/44; 118/68; 118/408; 118/DIG. 10

[58] Field of Search ..... 118/408, 56, 105, 117, 118/DIG. 10, 18, 20, 103, 106, 44, 68; 427/230, 238, 394; 138/118.1; 426/135, 138, 105; 226/181, 193, 172

[56] References Cited

U.S. PATENT DOCUMENTS

| | | | |
|---|---|---|---|
| 3,934,309 | 1/1976 | Sheridan | 17/42 |
| 3,938,220 | 2/1976 | Sheridan et al. | 17/42 |
| 4,353,940 | 10/1982 | Becker et al. | 427/238 |
| 4,357,371 | 11/1982 | Heinrich et al. | 118/408 |
| 4,397,891 | 8/1983 | Kaelberer et al. | 118/105 |

FOREIGN PATENT DOCUMENTS

| | | | |
|---|---|---|---|
| 2557994 | 6/1977 | Fed. Rep. of Germany . | |
| 2659000 | 7/1978 | Fed. Rep. of Germany | 118/408 |
| 2856253 | 7/1980 | Fed. Rep. of Germany | 118/408 |
| 8110471 | 4/1981 | Fed. Rep. of Germany . | |

*Primary Examiner*—John P. McIntosh

*Attorney, Agent, or Firm*—Schwartz, Jeffery, Schwaab, Mack, Blumenthal & Evans

[57] ABSTRACT

Disclosed is a conveying device for conveying a tubing and a fluid contained therein. Also disclosed is an apparatus for internally coating a flexible tubing, wherein the apparatus includes the disclosed conveying device.

20 Claims, 3 Drawing Figures

DEVICE FOR CONVEYING A FLEXIBLE TUBING AND A FLUID MEDIUM CONTAINED THEREIN

BACKGROUND OF THE INVENTION

The present invention relates to a conveying device for conveying a tubing and a fluid medium contained in the tubing.

A device of this type finds application, for example, as part of an apparatus for internally coating flexible tubings. The device is used to convey the tubing in a direction along the longitudinal axis of the tubing, and also to convey a coating solution contained in the interior of the tubing in the direction of the tube movement. In so doing the device should ensure that the liquid level in the tubing is kept at a substantially constant level, keeping in mind that the quantity of coating solution used depends on the speed of the tubing.

German Auslegeschrift No. 25 57 994 describes a device, in which a tubing filled with coating solution is moved in the direction of its longitudinal axis at a constant speed, while at the same time liquid is transported upwardly in that portion of the tubing which is conveyed vertically upwardly. According to the document, by this measure the liquid level is kept at its initial height during the course of the process.

In this known device, a plurality of rotatable rollers are fastened to two roller stars, whereby each roller star rotates about its center point and at the same time traces a swinging motion in the direction of the tubing surface. Due to these various, superposed movements, it is technically very complicated to continuously achieve a precise adaptation of the circumferential speed of the rollers to the speed of the tubing, and additionally, to compensate for the slip which usually occurs on pressure rollers in the case of a spot contact. Therefore, from the control engineering point of view, driving the rollers is very complicated, if not entirely impossible. For proper operation, the roller speed has to correspond to the speed of the conveyed tubing minus the speed of the roller stars. The resulting motion is non-uniform and sine-shaped, and further depends on the quantity of liquid to be transported, which in turn depends on the diameter of the tubing employed.

Another device for performing such a process is described in German Auslegeschrift No. 26 59 000. This device comprises two conveyor belt-type endless belts with sine-shaped curvature on their outer surfaces. Firstly, the manufacture of these belts is technically very complicated. Additionally, these endless belts particularly have the disadvantage of undergoing non-uniform elongation during operation. Thus, the quantity of liquid conveyed can change undesirably. Moreover, adjusting the drive and mutually shifting the curvatures of the endless belts to achieve the exactness required is very difficult and susceptible to malfunction. Furthermore, there is the danger that the tubing may be damaged when engaged by two opposite bulgings of the endless belts. At the very least, the endless belts and the tubing are subject to severe wear and high mechanical stress due to their relative movement.

These same disadvantages are exhibited by the conveying and pumping device for internally coating tubings, which is disclosed in German Offenlegungsschrift No. 28 56 253. The device comprises a conveyor belt-type endless belt and a cylindrical roller, both of which are provided with profiled areas which are uniformly spaced around the entire circumference of the surfaces.

In each of these devices, the liquid level is subject to strong fluctuations due to the fact that the liquid stream is delivered in a pulsating manner.

The device described in German Offenlegungsschrift No. 28 56 253 has been further developed into the device disclosed in German Utility Model No. 81 10 471, which evidences a non-profiled conveyor belt-type endless belt. Nevertheless, the mechanical stress exerted on the tubing by the action of the conveying means is still relatively high. Additionally, according to this device, the quantity of liquid which can be conveyed is restricted to the cavities formed by the bulgings. Moreover, an undesirable back flow of the liquid in the direction opposite the direction in which the tubing is moved cannot be excluded, since there is not a sufficiently pressure-tight seal between roller and belt. Furthermore, none of the aforementioned devices offers the possibility of conveying only the liquid contained in the tubing, while the tubing stands still, or, alternatively, of conveying only the tubing without conveying the liquid, or even of conveying the liquid in the direction opposite to the direction in which the tubing is moved. Additionally, it is impossible to achieve an exact adjustment of the relative speed between the movement of the tubing and the liquid transport, independent of the speeds at which the tubing and the liquid are conveyed.

SUMMARY OF THE INVENTION

It is therefore an object of the present invention to provide a device for conveying a flexible tubing and the liquid enclosed therein.

Another object of the present invention is to provide a device which in a more simple manner simultaneously conveys a tubing and a liquid contained therein, without damaging the tubing.

Yet another object is the provision of a device of the above type which forms a pressure-tight seal and thus prevents an undesired counterflow of the liquid due to the pressure of the liquid column.

Still yet another object of the invention is to provide such a device wherein it is possible to vary the quantity of conveyed liquid easily and within a wide range, and, if desired, to convey the liquid in the direction opposite to the direction in which the tubing is conveyed.

A further object resides in the possibility of stopping the transport of the liquid completely, while the transport of the tubing is continued.

In accomplishing the foregoing objects, there has been provided in accordance with one aspect of the present invention a device for conveying a flexible, fluid-containing tubing along its longitudinal axis, comprising a rotatable first conveying element having an essentially smooth circumferential surface, and a rotatable second conveying element having a number of equally-spaced elevations, wherein the conveying elements are arranged opposite one another for receiving therebetween a flexible, fluid-containing tube which passes perpendicularly to the axis of rotation of the conveying elements, wherein the elevations of the second conveying element press against the smooth surface of the first conveying element to compress the tubing at distances equal to the distances between said elevations. The elevations of the second conveying element comprise a plurality of circular, cylindrical rollers which are attached in a freely rotatable and non-driven manner to the circumference of the second conveying element and are aligned so that the axes of rotation of the rollers are parallel to the axis of the second conveying element and to each other and wherein the diameters of the rollers are small relative to the diameter of the second conveying element.

In accordance with another aspect of the present invention, there has been provided an apparatus for producing an internally coated flexible tubing, comprising means for providing a flexible tubing, means for introducing a coating solution to the interior of the tubing, means for conveying the fluid-containing tubing, comprising a conveying device as described above, means for transporting the fluid-containing tubing in a vertical direction to form a layer of the coating solution on the inner walls of the tubing, a dryer, and means for passing the coated tubing through the dryer.

Further objects, features and advantages of the present invention will become apparent from the detailed description of preferred embodiments which follows, when considered together with the attached figures of drawing.

BRIEF DESCRIPTION OF THE DRAWINGS

The invention will now be explained in greater detail by reference to the embodiments shown in the drawings.

In the drawings.

DETAILED DESCRIPTION OF PREFERRED EMBODIMENTS

Figure 1:
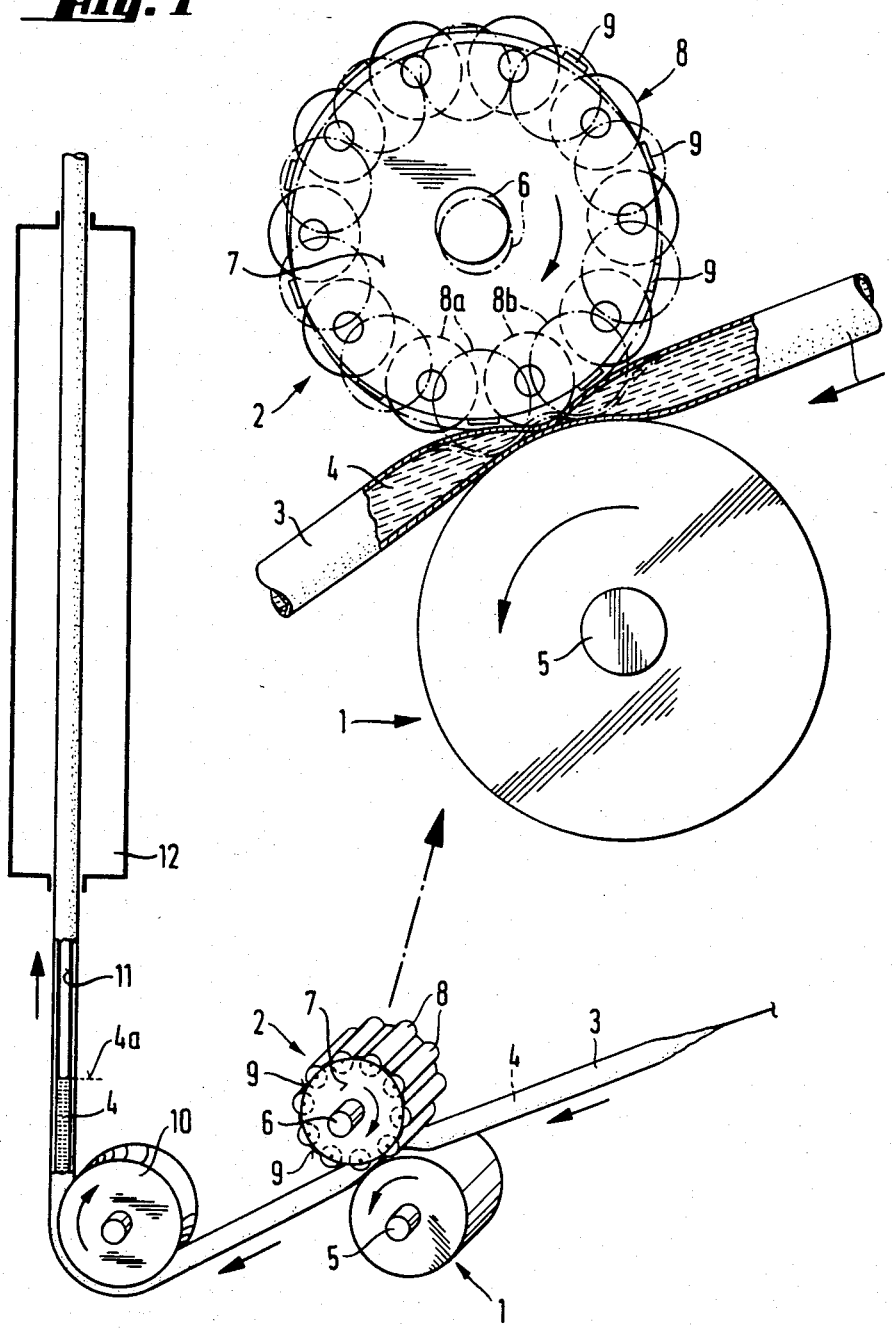
FIG. 1 schematically illustrates the mode of operation of a device according to the present invention comprising two roller- or wheel-shaped conveying elements, in a process for internally coating a tubing.

The device according to the present invention comprises two conveying elements in the form of cylindrical rollers, wheels or endless belts, which are passed over a plurality of guide rollers. The two conveying elements are positioned opposite one another, leaving a gap through which the tubing is transported, in a direction which is perpendicular to the axes of rotation of the conveying elements. The two conveying elements can be rotated about their central axes and separately driven.

The first conveying element possesses a substantially smooth circumferential surface, i.e., its cross section is essentially circular or straightlined, without elevations. The circumferential surface of the second conveying element is provided with a number of elevations in the form of freely rotatable rollers, the circumferences of which are small compared with the circumferences of the conveying elements. The rollers are fastened to the circumference of the second conveying element by their axes of rotation.

As a result of the rollers of the second conveying element, sections of the tubing are pressed against the smooth circumferential surface of the first conveying element, over the entire width of the tubing and perpendicularly to its longitudinal axis, so that the tubing is laid completely flat in those areas where pressure is exerted. Between two compressed portions of the tubing, a portion of the total quantity of liquid is enclosed which, by the rotation of the rollers of the second conveying element, can be moved in the direction in which the tubing is conveyed or, alternatively, in the opposite direction.

The speed of the rollers, and thus the quantity of liquid conveyed, depends on the speed of rotation of the second conveying element. The second conveying element is a rotatably driven unit rotating about its axis of rotation in the case where the second conveying element is wheel- or roller-shaped, and about a driven guide roller in the case where the second conveying element is in the form of an endless belt.

In general, the two conveying elements are driven at different speeds, with the first conveying element being used merely to move the tubing. By an appropriate control of the speed of rotation of the first conveying element, the speed at which the tubing is advanced is determined and can be varied accordingly. Correspondingly, the quantity of conveyed liquid is determined by the speed of rotation of the second conveying element.

Whereas the first conveying element must always be rotated in the direction in which the tubing is conveyed, the direction of rotation of the second conveying element depends on whether the liquid is to flow in the direction in which the tubing is conveyed or in the opposite direction. It is also possible to stop the motion of the second conveying element in those cases where only the tubing is to be transported, and not the contained liquid.

Thus, the second conveying element acts as a metering or locking means for the liquid, and its adjustment is independent of the movement of the tubing. Since the quantity of liquid conveyed during each revolution of the second conveying element is constant, the total amount of conveyed liquid can be determined by appropriately adjusting the speed of the variable drive unit of this element. In addition, it is possible to convey surplus liquid opposite to the direction of travel of the tubing by reversing the direction of rotation.

Due to the fact that the rollers can be freely rotated, only nominal friction is created between the rollers and the conveying elements which have different speeds of rotation and possibly rotate in the same direction, so that there is no danger that the tubing may be damaged. The pressure exerted on the circumference of the tubing by the two conveying elements can even be sufficiently great so as to ensure a pressure-tight enclosure of the liquid, so that the pressure exerted by the liquid column is unable to cause the liquid to flow back, opposite to the direction in which it is conveyed.

If one of the conveying elements has the shape of a wheel or roller, it is fastened on its shaft in such a way that it can be centrically rotated and driven. If the conveying element is a conveyor belt, it is moved over centrically rotatable guide wheels or guide rollers, whereby one of these guide wheels or rollers can be driven and is coupled to the conveyor belt.

If the second conveying element is designed as a roller or wheel, it is preferably arranged perpendicularly to the first conveying element and at a distance from the latter, so that this roller is lifted perpendicularly to the first conveying element when a roller presses against the latter.

The surface of those parts of the device which come into contact with the surface of the tubing are advantageously made of a soft, elastic material, for example, rubber.

In a preferred embodiment, displacement bodies are provided between two neighboring rollers, by which a pulsating flow of the conveyed liquid is reduced or avoided. As a result of the displacement bodies, which are designed as tapes or rods, the tubing is squeezed together slightly between two compressions, without being laid completely flat. When the diameter of the rollers is very small, for example, 2 cm, a rather uniform flow of the liquid is achieved without displacement bodies. In these cases it is, however, necessary to increase the speed of rotation of the second conveying element.

The device may, for example, comprise a part of an apparatus for internally coating tubings. The liquid used for the internal coating is continuously supplied in the direction in which the tubing is conveyed, in a quantity depending on the liquid consumed. Thereby, the liquid is adjusted to a predetermined level in the vertically ascending portion of the tubing which is downstream of the device, with care being taken to provide a constant distance between the liquid level and the inlet aperture of the drying device also positioned downstream. In this way, a substantially uniform internal coating is achieved. Adjustment of the quantity of liquid conveyed within a defined time period can be performed quite easily by appropriately adjusting the speed of rotation of the second conveying element acting on the outside of the tubing. The agent suitable for forming the coating is contained in the liquid in the dissolved or dispersed state.

By means of the device of the present invention it is thus possible to convey a tubing, filled with a fluid medium, at a preset speed, and, at the same time, to convey the medium contained in the tubing in any desired direction, whereby the transport of the fluid medium can be controlled independently of the tubing. Additionally, the device provides for the conveyance of both extremely high and low quantities of the medium.

By the interaction of the two conveying elements, only nominal mechanical stress is exerted on the tubing, so that there is practically no danger that the casing may become damaged.

With reference now to the drawings, according to FIG. 1, a tubing 3 is drawn from a supply roll (not shown) and conveyed in the direction of its longitudinal axis. The tubing is filled with coating liquid 4, and its path of transport is inclined downwardly. The conveying device comprises a first conveying element 1 in the form of a roller having the shape of a circular cylinder with a plain circumferential surface, i.e., a circular cross section, and a second conveying element 2 having a roller-shaped cross section. Driving means (not shown) cause the elements 1, 2 to rotate about their axes 5, 6. The second element 2 is comprised of two circular discs 7 and freely rotatable rollers 8 having rubberized circumferential surfaces. The shafts 17 (see FIGS. 2 and 3) of the rollers 8 are fastened to the circular discs 7, near their circumference. Displacement bodies 9 are provided between the rollers 8. The tubing 3 is directed vertically upwardly by the deviating roller 10. Reference 4*a* denotes the level of the coating liquid 4 which is kept constant by the conveying device. Above the level 4*a*, the inside wall of the tubing is coated with a layer 11 of coating liquid. In the drying channel 12, the solvent is evaporated by heating, and a solid coated layer is formed on the inside wall of the tubing.

The tubing 3 is transported by the first element 1 which, therefore, is driven at the same speed as any, subsequently arranged rollers, for example, rollers to draw the tubing from the drying channel 12 or wind up the coated tubing. These rollers, as well as means for adapting their speed of rotation to the speed of the conveying element 1, are not illustrated.

The speed of rotation of the second element 2 is usually different from the speed of the first element. The second element is driven by a variable driving mechanism (not illustrated). A gap is formed between the rollers 8 of the second element 2 and the first element 1. When the tubing 3 is conveyed through this gap, it is compressed by one or two rollers 8, depending on the position of the second element 2, so that the liquid is hermetically enclosed. The rollers 8 rotate merely as a result of the contact produced between the rollers and the moving tubing 3 and the first element 1, so that practically no friction is generated between the tubing 3 and the conveying element 2 which has a different speed. When the two rollers 8*a* and 8*b* are in contact with the first element 1 arranged below, a cushion of liquid is present between the two rollers 8*a*, 8*b*. By the rotary movement of the second element 2 the roller 8*a* is lifted, and the roller 8*b* presses the liquid in the direction in which the tubing is conveyed. At the same time, the second element 2 is lifted vertically upwardly. Lifting and lowering of the second element 2 may, for example, take place about a pivot by means of a lever arm and a pneumatically operated appliance. The parts, illustrated by alternating dash and dot lines, show the device at a moment where it is shifted relative to the position indicated by the solid and broken lines. The pressure, which in the interior of the tubing is exerted onto the device by the coating liquid, depends on the height of the level 4*a* and amounts, for example, to about 0.4 bar.

Figure 2:
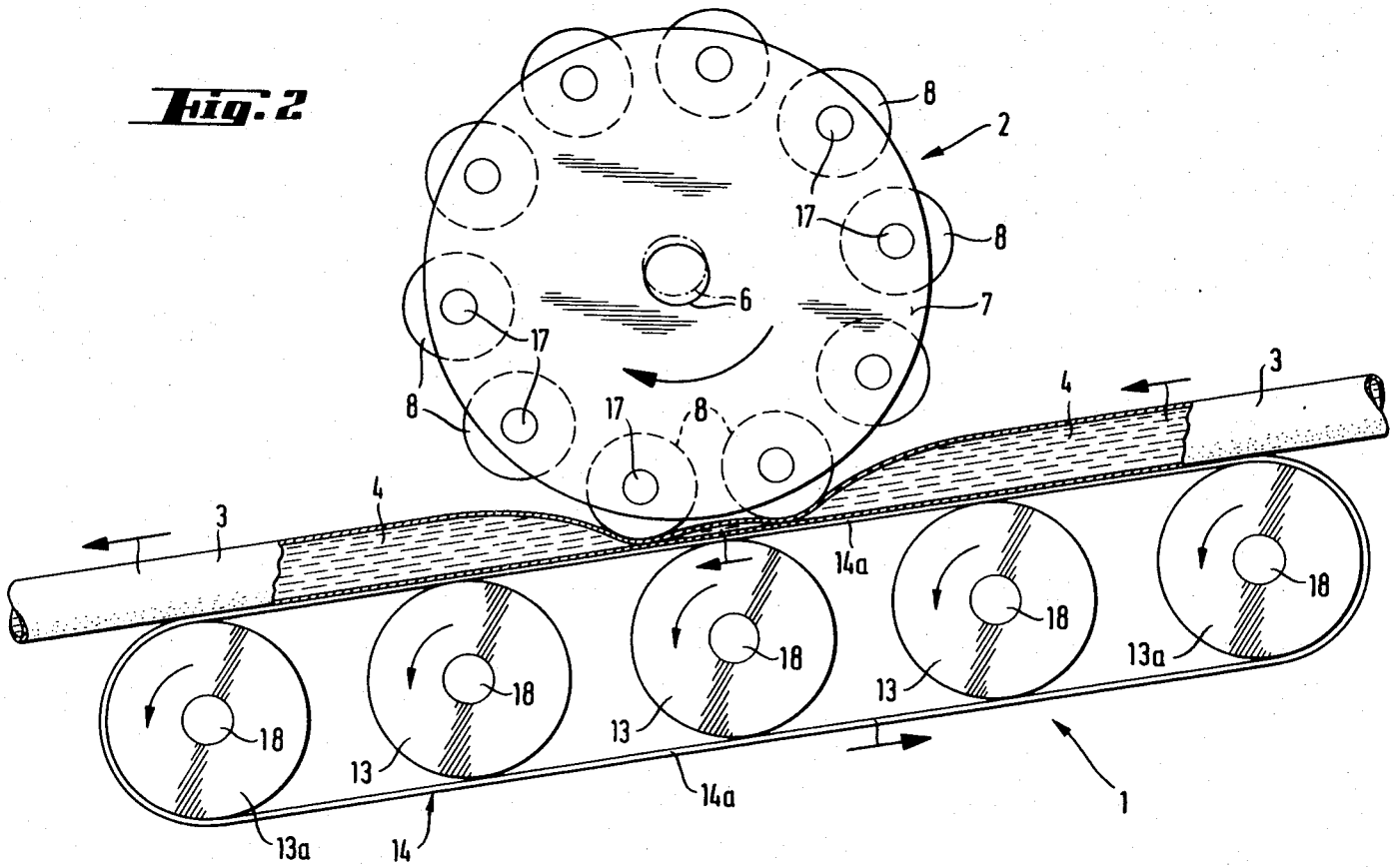
FIG. 2 schematically illustrates an embodiment of the invention comprising one roller-shaped conveying element and one conveyor belt-shaped conveying element.
Figure 3:
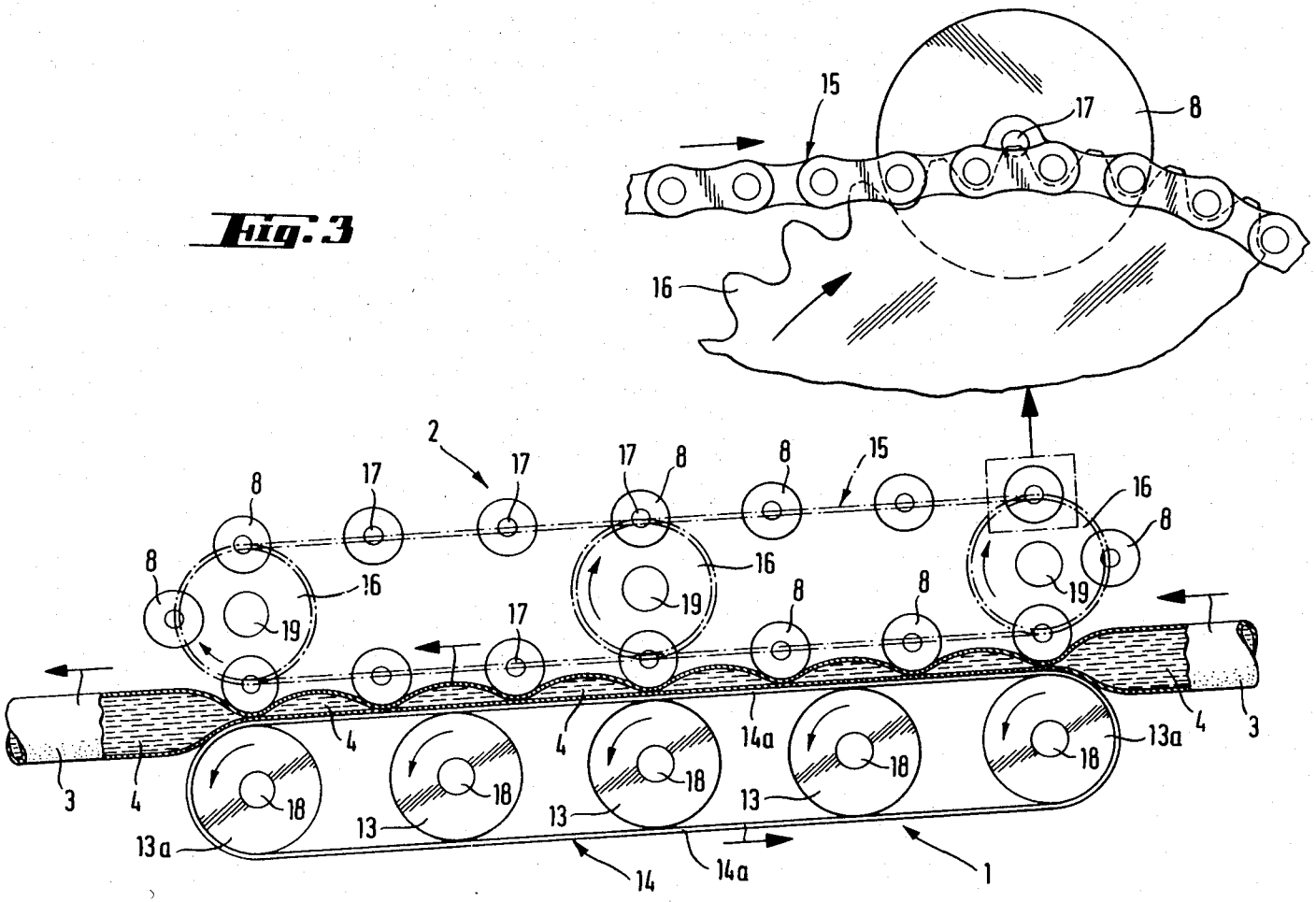
FIG. 3 schematically illustrates an embodiment of the device comprising two belt-type conveying elements.

In FIGS. 2 and 3, the reference numbers denote the same items as in FIG. 1. In each case, the first conveying element 1 is designed as an endless belt 14 running over a number of guide rollers 13, 13*a*, all of which are of identical size. Each endless belt is comprised of two parallel, essentially planar portions 14*a* and two bent, semi-circular portions, each of which is in contact with guide rollers 13*a*, whereby one of these rollers 13*a* is driven. The axes of rotation 18 of all rollers 13, 13*a* extend horizontally and run parallel to each other. The second conveying element 2 rotates about the shaft 6, whereby the complete element 2 is moved up and down, perpendicularly to the planar portion 14*a* of the endless belt. This movement is indicated by the shaft 6 in dash and dotted lines.

In FIG. 3, the rollers 8 are fastened to a chain 15 in a freely rotatable manner. This chain 15 runs over chain wheels 16, one of which can be driven. The reference number 19 denotes the axes of rotation of the chain wheels 16.

What is claimed is:

1. A device for conveying a flexible, fluid-containing tubing along its longitudinal axis, comprising:

a movable first conveying element having an essentially smooth endless circumferential surface without elevations;

a movable second conveying element having an endless circumferential surface and a number of equally-spaced elevations, wherein said conveying elements are arranged opposite one another for receiving therebetween a flexible, fluid-containing tubing passing parallel to the direction of movement of said conveying elements, and wherein said elevations of said second conveying element press toward the smooth surface of said first conveying element to compress said tubing at distances equal to the distances between said elevations;

means for movably driving said conveying elements; and said elevations of said second conveying element comprise a plurality of circular, cylindrical rollers which are attached in a freely rotatable and non-driven manner to the circumference of said second conveying element and are aligned so that the axes of rotation of said rollers are transverse to the direction of movement of said second conveying element and are parallel to each other and wherein the circumference of each of said rollers is small relative to the circumference of said second conveying element.

2. A conveying device as claimed in claim 1, wherein said first conveying element comprises a circular cylindrical roller.

3. A conveying device as claimed in claim 1, wherein said first conveying device comprises an endless belt.

4. A conveying device as claimed in claim 1, wherein said first conveying device comprises a wheel.

5. A conveying device as claimed in claim 1, wherein said second conveying element comprises a circular body.

6. A conveying device as claimed in claim 5, wherein said second conveying element comprises a roller-shaped body.

7. A conveying device as claimed in claim 1, wherein said second conveying element comprises an endless belt.

8. A conveying device as claimed in claim 1, wherein said rollers comprise smooth surfaces.

9. A conveying device as claimed in claim 1, wherein the surface of said rollers is coated with elastomeric material.

10. A conveying device as claimed in claim 9, wherein said elastomeric material comprises a rubber.

11. A conveying device as claimed in claim 1, including means for moving said conveying elements at different speeds.

12. A conveying device as claimed in claim 1, including means for moving said conveying elements in the same direction.

13. A conveying device as claimed in claim 1, including means for moving said conveying elements in opposite directions.

14. A conveying device as claimed in claim 1, wherein said first conveying device moves in the direction of the movement of said flexible tubing.

15. A conveying device as claimed in claim 14, wherein said second conveying device is stationary in rotational motion.

16. An apparatus for producing an internally coated flexible tubing from a fluid-containing tubing, comprising:

a conveying device for the fluid-containing tubing, said conveying device comprising a device according to claim 1;

means for transporting the fluid-containing tubing in an upwardly vertical direction to form a layer of said coating solution on the inner walls of the tubing;

a dryer; and means for passing the coated tubing through said dryer.

17. An apparatus as claimed in claim 16, wherein said conveying device controls the level of said coating solution.

18. A device for conveying a flexible, fluid-containing tubing along its longitudinal axis, comprising:

a movable first conveying element having an essentially smooth endless circumferential surface;

a movable second conveying element having an endless circumferential surface and a number of equally-spaced elevations, wherein said conveying elements are arranged opposite one another for receiving therebetween a flexible, fluid-containing tubing passing parallel to the direction of movement of said conveying elements, and wherein said elevations of said second conveying element press toward the smooth surface of said first conveying element to compress said tubing at distances equal to the distances between said elevations;

means for movably driving said conveying elements independently, wherein said conveying elements can be driven during operation in the same or opposite directions or one of said elements can be at rest; and said elevations of said second conveying element comprise a plurality of circular, cylindrical rollers which are attached in a freely rotatable and non-driven manner to the circumference of said second conveying element and are aligned so that the axes of rotation of said rollers are perpendicular to the direction of movement of said second conveying element and are parallel to each other and wherein the circumference of each of said rollers is small relative to the circumference of said second conveying element.

19. A device for conveying a flexible, fluid-containing tubing along its longitudinal axis, comprising:

a movable first conveying element having an essentially smooth endless circumferential surface for transporting a flexible, fluid-containing tubing;

a movable second conveying element having an endless circumferential surface and a number of equally-spaced elevations for controlling the amount of the fluid in said tubing leaving said conveying elements, wherein said conveying elements are arranged opposite one another for receiving therebetween said flexible, fluid-containing tubing passing parallel to the direction of movement of said conveying elements, and wherein said elevations of said second conveying element press toward the smooth surface of said first conveying element to compress said tubing at distances equal to the distances between said elevations;

means for movably driving said conveying elements independently, wherein said conveying elements can be driven during operation in the same or opposite directions or one of said elements can be at rest; and said elevations of said second conveying element comprise a plurality of circular, cylindrical rollers which are attached in a freely rotatable and non-driven manner to the circumference of said second conveying element and are aligned so that the axes of rotation of said rollers are perpendicular to the direction of movement of said second conveying element and are parallel to each other and wherein the circumference of each of said rollers is small relative to the circumference of said second conveying element.

20. A device for conveying a flexible, fluid-containing tubing along its longitudinal axis, comprising:

a movable first conveying element having an essentially smooth endless circumferential surface;

a movable second conveying element having an endless circumferential surface and a number of equally spaced elevations, wherein said conveying elements are arranged opposite one another for receiving therebetween a flexible, fluid-containing tubing passing parallel to the direction of movement of said conveying elements, and wherein said elevations of said second conveying element press toward the smooth surface of said first conveying element to compress said tubing at distances equal to the distances between said elevations;

means for movably driving said conveying elements independently, wherein said conveying elements can be driven during operation in the same or opposite directions or one of said elements can be at rest;

wherein said elevations of said second conveying element comprise a plurality of circular, cylindrical rollers which are attached in a freely rotatable and non-driven manner to the circumference of said second conveying element and are aligned so that the axes of rotation of said rollers are perpendicular to the direction of movement of said second conveying element and are parallel to each other and wherein the circumference of each of said rollers is small relative to the circumference of said second conveying element; and further comprising displacement bodies positioned between consecutive rollers which extend parallel to the axes of said rollers and are at a distance of greater than twice the tubing thickness from said smooth surface of said first conveying element in the compressed position.

* * * * *